US009543648B2

(12) United States Patent
Cheng et al.

(10) Patent No.: US 9,543,648 B2
(45) Date of Patent: Jan. 10, 2017

(54) SWITCHABLE ANTENNAS FOR WIRELESS APPLICATIONS

(71) Applicant: Commsky Technologies, Inc., Santa Clara, CA (US)

(72) Inventors: Po-shin Cheng, Femont, CA (US); Xin Li, HangZhou (CN); Daniel Wang, San Jose, CA (US); Jun Shen, Palo Alto, CA (US); George Zhao, Palo Alto, CA (US)

(73) Assignee: Commsky Technologies, Inc., Santa Clara, CA (US)

( * ) Notice: Subject to any disclaimer, the term of this patent is extended or adjusted under 35 U.S.C. 154(b) by 114 days.

(21) Appl. No.: 14/270,362

(22) Filed: May 6, 2014

(65) Prior Publication Data

US 2015/0244070 A1 Aug. 27, 2015

Related U.S. Application Data

(63) Continuation-in-part of application No. 13/872,078, filed on Apr. 27, 2013.

(51) Int. Cl.

| | |
|---|---|
| ***H01Q 3/24*** | (2006.01) |
| ***H01Q 1/38*** | (2006.01) |
| ***H01Q 19/10*** | (2006.01) |
| ***H01Q 19/30*** | (2006.01) |
| ***H01Q 21/20*** | (2006.01) |
| ***H01Q 21/24*** | (2006.01) |

(52) U.S. Cl.

CPC ..... *H01Q 3/24* (2013.01); *H01Q 1/38* (2013.01); *H01Q 19/108* (2013.01); *H01Q 19/30* (2013.01); *H01Q 21/20* (2013.01); *H01Q 21/24* (2013.01)

(58) Field of Classification Search

CPC .... H01Q 19/108; H01Q 21/062; H01Q 21/20; H01Q 21/205; H01Q 9/065; H01Q 25/005; H01Q 19/005; H01Q 21/24; H01Q 21/245

See application file for complete search history.

(56) References Cited

U.S. PATENT DOCUMENTS

| | | | | |
|---|---|---|---|---|
| 2007/0103377 | A1* | 5/2007 | Abramov | G06F 1/1616 343/818 |
| 2007/0152903 | A1* | 7/2007 | Lin | H01Q 3/242 343/795 |
| 2009/0046019 | A1* | 2/2009 | Sato | H01Q 3/44 343/702 |
| 2011/0063181 | A1* | 3/2011 | Walker | H01Q 9/16 343/803 |
| 2014/0118191 | A1* | 5/2014 | Smith | H01Q 19/30 342/372 |

* cited by examiner

*Primary Examiner* — Graham Smith
*Assistant Examiner* — Daniel J Munoz
(74) *Attorney, Agent, or Firm* — Joe Zheng

(57) ABSTRACT

Techniques of designing an antenna array with antenna units controlled electronically are described. Through controlling the combination of the reflectors in each of the antenna units, a desired antenna pattern is formed, adapting to the environment, and providing reliable and efficient links between two transceivers. According to one aspect of the present invention, a switch (e.g., a diode) is used to couple two reflectors. The diode is controlled to be on or off so that the reflectors are conductively integrated or separated.

14 Claims, 5 Drawing Sheets

SWITCHABLE ANTENNAS FOR WIRELESS APPLICATIONS

CROSS-REFERENCE TO RELATED APPLICATION

This is a continuation-in-part of co-pending U.S. application Ser. No. 13/872,078, entitled "Multi-channel multi-sector smart antenna system", filed Apr. 27, 2013.

BACKGROUND OF THE INVENTION

Field of Invention

The invention generally is related to the area of antennas, and more particularly related to integrated antenna arrays structured in a way and controlled electronically to form a desired antenna pattern adapting to an environment, and providing reliable and efficient links between two transceivers.

Related Art

An antenna system is an indispensable component in communication systems. In conventional wireless communications, a single antenna is used at the source, and another single antenna is used at the destination. This is called SISO (single input, single output). Such systems are vulnerable to problems caused by multipath effects. When an electromagnetic field (EM field) is met with obstructions such as hills, canyons, buildings, and utility wires, the wavefronts are scattered, and thus they take many paths to reach the destination. The late arrival of scattered portions of the signal causes problems such as fading, cut-out (cliff effect), and intermittent reception (picket fencing). In a digital communications system like the Internet, it can cause a reduction in data speed and an increase in the number of errors.

The use of smart antennas can reduce or eliminate the trouble caused by multipath wave propagation from reflection, deflection, refraction, and scattering. A smart antenna is a digital wireless communications antenna system that takes advantage of diversity effect at the source (transmitter), the destination (receiver), or both. Diversity effect involves the transmission and/or reception of multiple radio frequency (RF) waves to increase data speed and reduce the error rate. Smart antennas (also known as adaptive array antennas, multiple antennas and, recently, MIMO) are antenna arrays with smart signal processing algorithms used to identify spatial signal signature such as the direction of arrival (DOA) of the signal, and use it to calculate beamforming vectors, to track and locate the antenna beam on a mobile target.

Most of the smart antennas in use today have some undesired nulls in the antenna patterns. In radio electronics, a null is an area or vector in an antenna radiation pattern where the signal cancels out almost entirely. If not carefully planned, nulls can unintentionally prevent reception of a signal and fail to transmit a signal. There is a need for an antenna system that has a controllable antenna pattern without developing nulls.

SUMMARY OF THE INVENTION

This section is for the purpose of summarizing some aspects of the present invention and to briefly introduce some preferred embodiments. Simplifications or omissions in this section as well as in the abstract may be made to avoid obscuring the purpose of this section and the abstract. Such simplifications or omissions are not intended to limit the scope of the present invention.

The present invention generally pertains to designs of antenna arrays with antenna units controlled electronically to form a desired antenna pattern adapting to the environment, and providing reliable and efficient links between two transceivers. According to one aspect of the present invention, one of the two transceivers is a Wi-Fi Access Point (AP) device and the other one of the two transceivers is a client device (e.g., a computing device or a mobile phone). The antenna units in an antenna array of the Wi-Fi AP device are electronically controlled to provide the most reliable links with each and every client device it is being connected to.

According to another aspect of the present invention, there are at least two sets of antenna units in an antenna array. These two sets of antenna units are driven by a source (e.g., a RF driving circuit). Each of the antenna units includes two separate reflectors that are linked together via a diode. Depending on the status (e.g., on or off), the radiation pattern of the antenna array is controlled electronically to provide the most reliable links with each and every client device it is being connected to. In principle, if there are n sets of antenna units in an antenna array, and each of the n sets of antenna units includes two reflectors, there are $2^n$ different radiation characteristics available to choose from.

Depending on implementation, the present invention may be implemented as a method, an apparatus or part of a system. According to one embodiment, the present invention is an antenna system that comprises: an antenna system that comprises: a substrate, at least two antenna units, each of the antenna units including two antennas and two reflectors, wherein two of the reflectors in each of the antenna units are coupled via a switch; and a switch control unit provided to control the switch electronically, wherein the switch is turned on or off to change a radiation pattern of the antenna system.

According to another embodiment, the present invention is an antenna system comprising a printed circuit board (PCB), four diodes, four antenna units, equally spaced from a center and disposed on four sides of the center, each of the antenna units including two antennas and two reflectors, wherein two of the reflectors in each of the antenna units are coupled via one of the four diodes, the two antennas and two reflectors are structured with copper straps on the PCB, and wherein the diodes are electronically controlled to be on or off to change a radiation pattern of the antenna system.

One of the objects, features and advantages of the present invention is to provide a smart antenna that is amenable to small footprint, broad operating wavelength range, enhanced antenna pattern, lower cost, and easier manufacturing process. Other objects, features, benefits and advantages, together with the foregoing, are attained in the exercise of the invention in the following description and resulting in the embodiment illustrated in the accompanying drawings.

BRIEF DESCRIPTION OF THE FIGURES

These and other features, aspects, and advantages of the present invention will be better understood with regard to the following description, appended claims, and accompanying drawings where:

DETAILED DESCRIPTION OF THE INVENTION

The detailed description of the invention is presented largely in terms of procedures, steps, logic blocks, processing, and other symbolic representations that directly or indirectly resemble the operations of communication devices coupled to networks. These process descriptions and representations are typically used by those skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams representing one or more embodiments of the invention do not inherently indicate any particular order nor imply any limitations in the invention. Unless specifically stated otherwise, whenever an application or a module is described herein to be configured to perform one or more tasks or achieve one or more objectives in the present invention, it means the application or a module is objectively designed, implemented, constructed, or architected for such.

Service providers are looking for antenna systems that provide high power gain with small physical size. Further, it is desirable to deploy an antenna system that is capable of delivering optimal radio frequency (RF) power covering a known span of azimuthal angles. One embodiment of the present invention provides a high-gain antenna system electronically controlled to provide a desired radiation pattern for each and every client device it is being engaged to communicate with. The physical arrangement of the antennas is unique and compact, and provides the best performance possible for a desirable angular coverage without creating nulls within the desirable coverage areas.

According to one embodiment, the antenna system is designed initially for the 2×2 Multiple input/Multiple output (MIMO) Wi-Fi architecture. The same design is also applicable to the 3×3 MIMO. Those skilled in the art shall appreciate that the designs described herein is equally applicable to the N×M MIMO architectures. Some of the features, advantages and benefits in the present invention include:

- The antenna system may have a number of antenna units to form a designed antenna pattern, these integrated antenna units are arranged in such a way that the antenna system is physically symmetric and has one RF source to drive all the antenna units simultaneously;
- The antenna units may be printed on a printed circuit board (PCB), which makes it possible for the antenna system to be placed in an enclosure.

Figure 1:
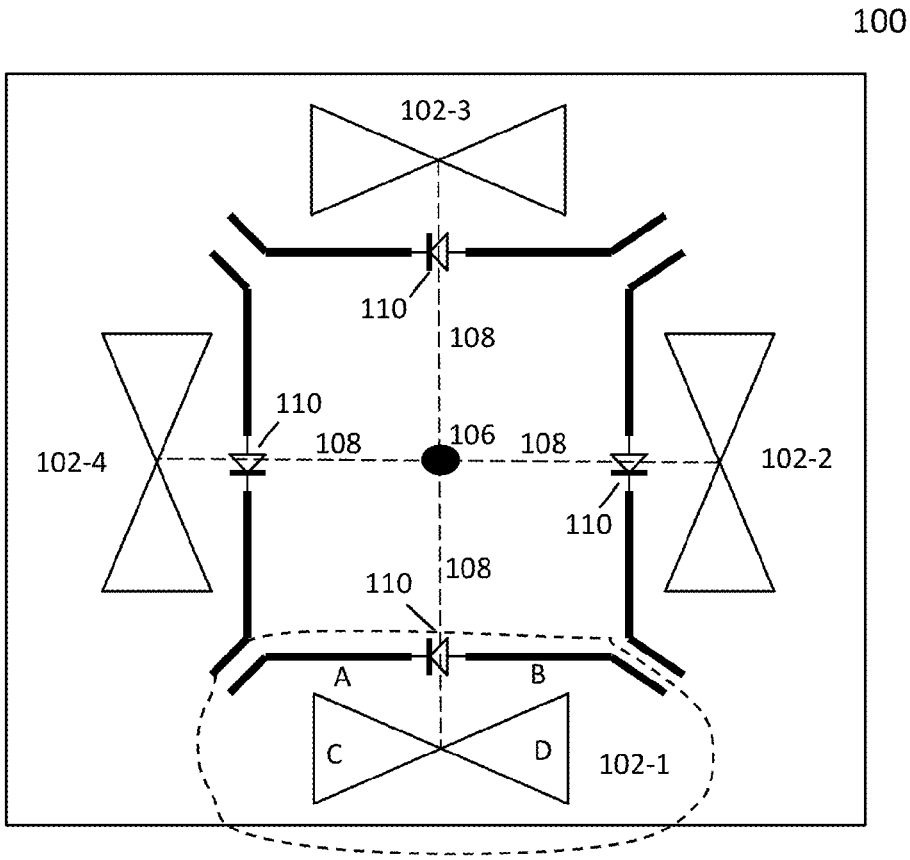
FIG. 1 shows an expanded view of an antenna array that may be constructed with physical elements or simply printed on a PCB, according to one embodiment of the present invention.

Referring now to the drawings, in which like numerals refer to like parts throughout the several views. According to one embodiment, FIG. 1 shows an expanded view of an antenna array 100 that may be constructed with physical elements or simply printed on a PCB. According to one embodiment, the array 100 is structured with four separate antenna units 102 (i.e., 102-1, 102-2, 102-3 and 102-4) arranged around a source 106 (e.g., a RF driving circuit). Each of the antenna units 102 includes two reflectors A and B and two radiators C and D. To facilitate the description of the present invention, each of the two radiators is presented as a dipole antenna. Those skilled in the art shall appreciate that other types of antenna may be used as a radiator in the antenna array 100.

Depending on implementation, the two reflectors A and B and two radiators C and D may be printed on the opposite sides on a PCB. Each of two reflectors A and B is extended slightly between two neighboring antenna units to minimize possible interference therebetween. According to one embodiment as shown in FIG. 1, the four antenna units 102 are squarely arranged, having equal distances to the source 106, and are driven by the source 106 via wires 108 (e.g., printed conductor straps on the PCB). Each of two reflectors A and B is bent on one end to further separate two antenna units. Those skilled in the art shall appreciate possible design variations of the two reflectors A and B given the detailed description of the present invention.

The two reflectors A and B are coupled via a diode 110. In electronics, a diode is a two-terminal electronic component with asymmetric conductance. It has low (ideally zero) resistance to current in one direction, and high (ideally infinite) resistance in the other. The most common function of a diode is to allow an electric current to pass in one direction (i.e., the diode forward direction) while blocking current in the opposite direction (i.e., the reverse direction). A semiconductor diode, the most common type today, is a crystalline piece of semiconductor material with a p-n junction connected to two electrical terminals.

By controlling the diode 110 so as to control the connection of the two reflectors A and B, the radiation pattern of the antenna array 100 shall change accordingly. When the diode 110 behaves like a short circuit, the reflectors A and B are physically connected together, and serve together as a reflector behind two radiators. When the diode behaves like an open circuit, the reflectors A and B are not connected together, and have little impact on the RF performance on the dipole elements next to each other. Since there are four diodes used in FIG. 4 for the four separate antenna units 102, in principle, there are $2^4=16$ different radiation characteristics available to choose from.

Figure 2A:
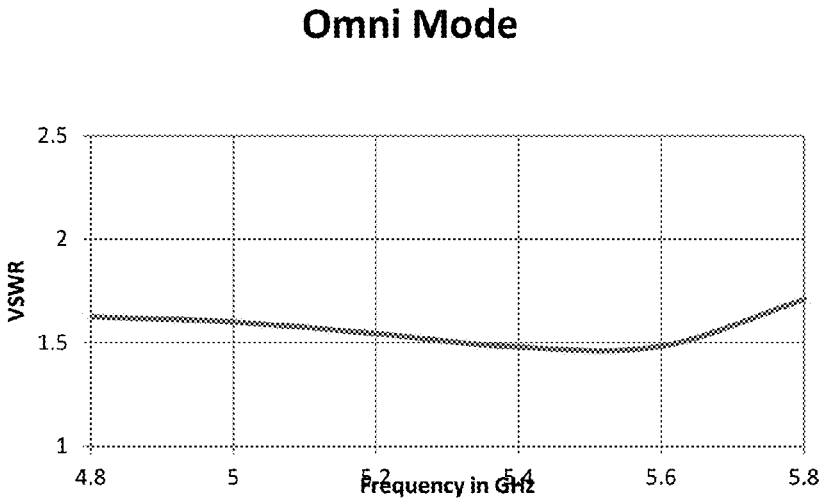
FIG. 2A is for an omni-mode of the antenna of FIG. 1, where all 4 diodes are all off, namely acting as open circuit.
Figure 2B:
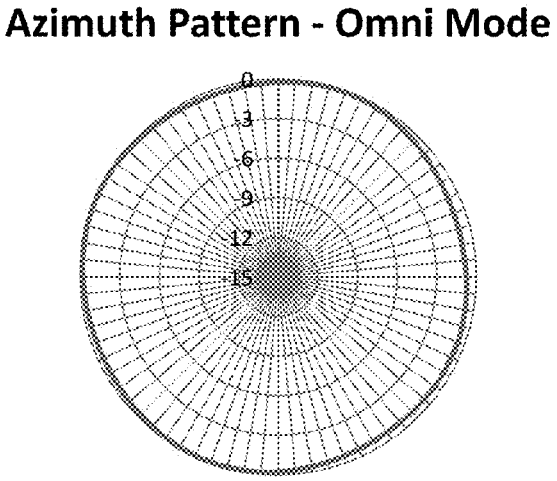
FIG. 2B shows a corresponding azimuth pattern of the omni-mode antenna.
Figure 3A:
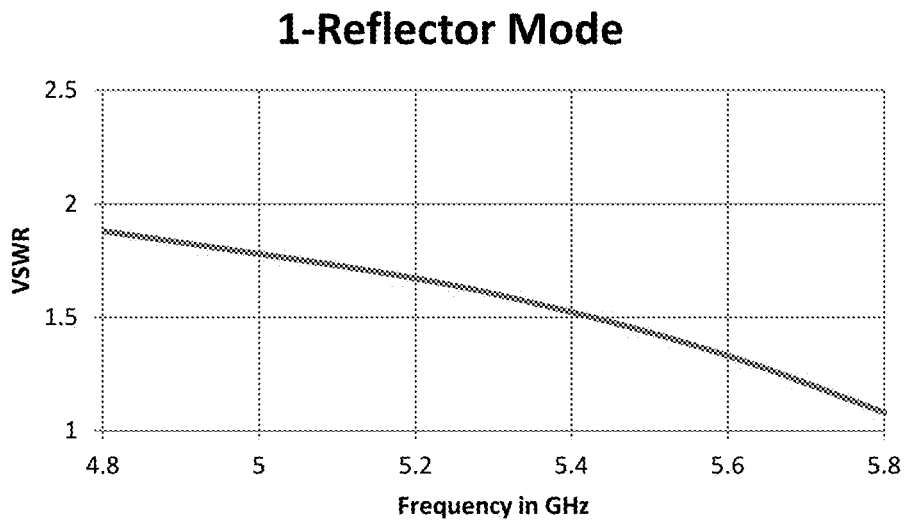
FIG. 3A is for a scenario, where any one of the 4 diodes behaves like a short circuit, namely two of the reflectors A and B are conductively connected.
Figure 4A:
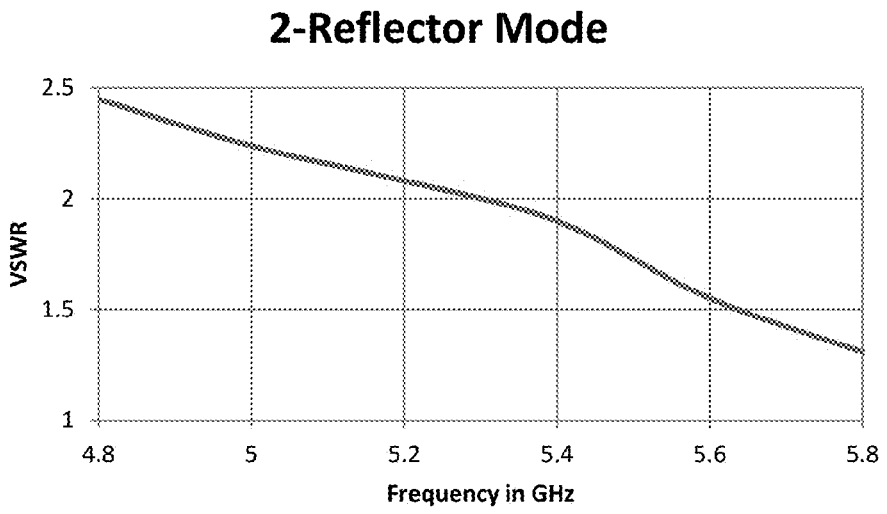
FIG. 4A is for a scenario, where any 2 adjacent diodes behave like a short circuit, namely two of the four antenna units have two conductively connected reflectors A and B while the other two antenna units have two disconnected reflectors A and B.

For an antenna to behave properly, it is essential to make sure that the radiation patterns and the input impedance are both designed to the acceptable specifications. FIGS. 2A, 3A and 4A show the VSWR performance of antenna operated at 3 different modes of the antenna array of FIG. 1, where VSWR stands for Voltage Standing Wave Ratio, is a function of the reflection coefficient, and describes the power reflected from the antenna. FIG. 2A is for an omni-mode, where all 4 diodes are all off, namely acting as open circuits. Each of the antenna units 102 works independently. FIG. 2B shows a corresponding azimuth pattern of the omni-mode.

Figure 3B:
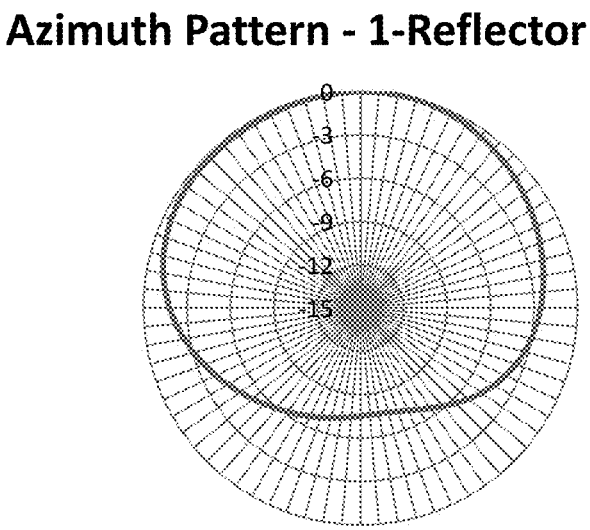
FIG. 3B shows a corresponding azimuth pattern of the scenario of FIG. 3A.

FIG. 3A is for a scenario, where any one of the 4 diodes behaves like a short circuit, namely two of the reflectors A and B are conductively connected. FIG. 3B shows a corresponding azimuth pattern of the scenario of FIG. 3A.

Figure 4B:
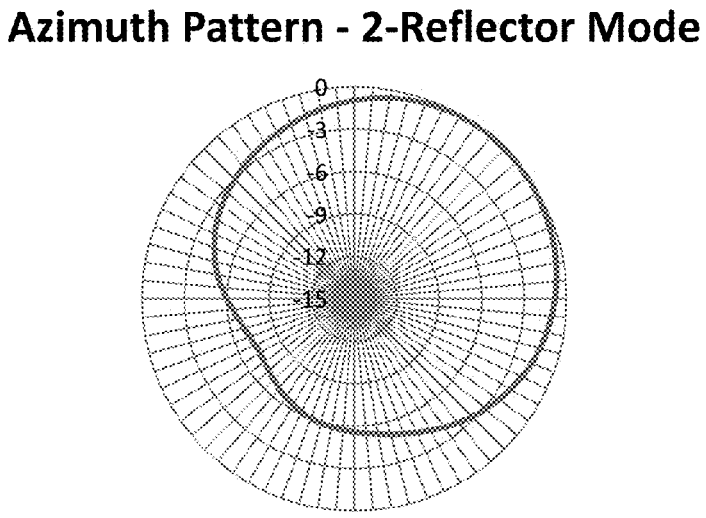
FIG. 4B shows a corresponding azimuth pattern of the scenario of FIG. 4A.

FIG. 4A is for a scenario, where any 2 adjacent diodes behave like a short circuit, namely two of the four antenna units have two conductively connected reflectors A and B while the other two antenna units have two disconnected reflectors A and B. FIG. 4B shows a corresponding azimuth pattern of the scenario of FIG. 4A.

Figure 5:
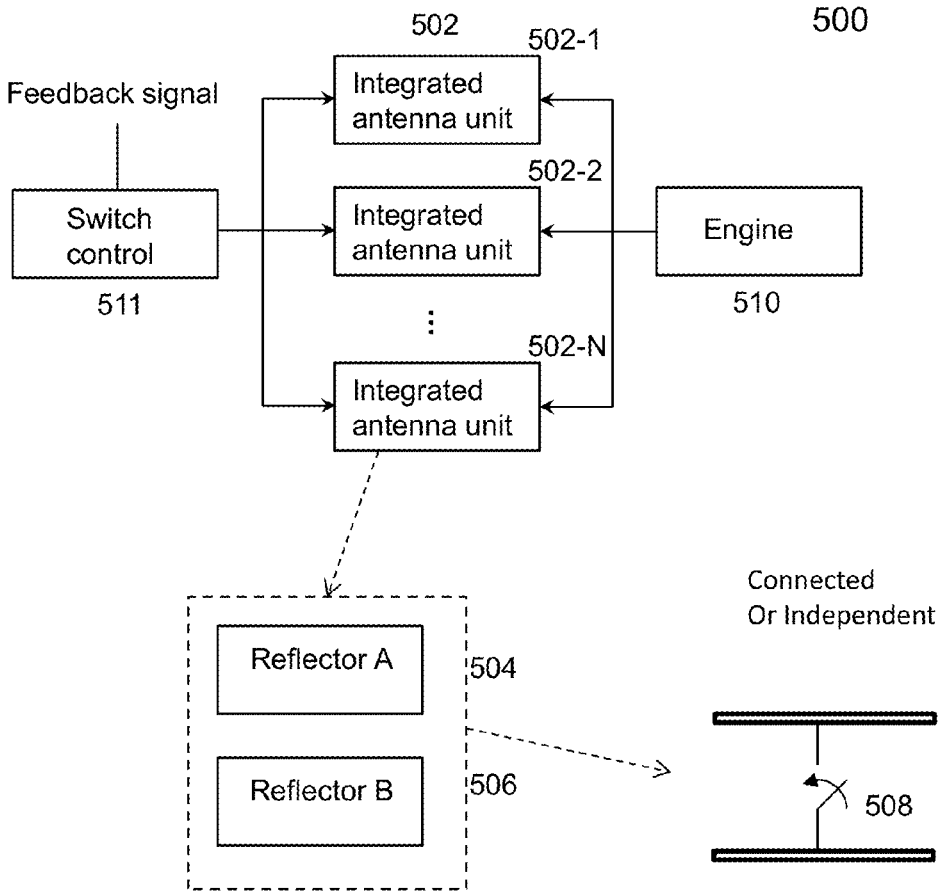
FIG. 5, it shows a system block diagram of an antenna system according to one embodiment of the present invention.

Referring now to FIG. 5, it shows a system block diagram of an antenna system 500 according to one embodiment of the present invention. As shown in FIG. 5, the antenna system 500 is structured with or includes a plurality of integrated antenna units 502, each of the integrated antennas units 502 may correspond to one of the antenna units 102 of FIG. 1 or includes at least two antennas with at least two reflectors A and B coupled via a switch 508. In one embodiment, the switch 508 is implemented with a diode that is electronically controlled to conductively couple the two reflectors A and B together or separate the two reflectors A and B.

As shown in FIG. 5, an engine 510 is provided to equally drive the integrated antenna units 502. Each of the antenna units 502 words independently. A switch control unit 511 is provided to control the switch 508 in each of the antennas units 502. By controlling the reflectors in each of the antenna units 502, the total radiation pattern can be controlled to provide reliable and efficient links between two transceivers. In one embodiment, the switch control unit 511 is designed to receive a feedback signal so as to determine which switch in which antenna unit to turn on or off. Such a feedback signal is received to indicate how to best facilitate the communication between the two transceivers. In the context of the invention, one or more switches are tuned on or off to reshape the radiation pattern of the antenna system 500.

Depending on implementation, there are ways to implement the switch used in the antenna system 500. In one embodiment, the switch is implemented with a diode that may be soldered across two of the reflectors.

According to one application, the antenna system 500 is structured in an enclosure and provided for wireless communications by one or more client devices. When there are multiple client devices (e.g., smart phones) communicating with the antenna system 500, the antenna system 500 is controlled to keep changing a corresponding radiation pattern to best serve a client device.

In an exemplary application, an access point (e.g., a Wi-Fi device) is equipped with the antenna system 100 and is accessed by a mobile device. The default omni-mode antenna pattern shown in FIG. 2B is judged no longer efficient. Ideally, the antenna pattern of the antenna system 500 in FIG. 4A shall be more directional towards the mobile device. Based on the RF signals exchanged between the two devices, the switch control unit 511 can be operative to selectively turn on two of the switches to cause two pairs of reflectors conductively connected while keeping the other switches off to reshape the default antenna pattern of FIG. 2B to a newly formed antenna pattern FIG. 4B.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claim. Accordingly, the scope of the present invention is defined by the appended claims rather than the forgoing description of embodiments.

We claim:

1. An antenna system comprises:

a substrate;

at least two antenna units each of the antenna units including two antennas, each of the two antennas including one radiator and one reflector, wherein two reflectors in each of the antenna units are coupled via a switch; and a switch control unit provided to control the switch electronically in each of the two antenna units, wherein the switch is turned on or off to connect or disconnect the two reflectors in each of the two antenna units so as to change a radiation pattern of the antenna system;

wherein each of the two reflectors is bent on one end and extended towards a gap between the two antenna units to isolate respective radiations from the two antenna units.

2. The antenna system as recited in claim 1, wherein the antenna units are equally driven by a power source.

3. The antenna system as recited in claim 2, wherein the antenna units are equally spaced from the power source.

4. The antenna system as recited in claim 1, wherein the substrate is a printed circuit board (PCB), the antenna units are structured using copper straps on the PCB.

5. The antenna system as recited in claim 4, wherein the antenna units are powered by the power source via respective copper straps on the PCB.

6. The antenna system as recited in claim 5, wherein the switch is a diode soldered across the two reflectors, the two reflectors are conductively connected when the diode is turned on and the two reflectors are physically disconnected when the diode is turned off.

7. The antenna system as recited in claim 4, wherein the two antennas are disposed on both sides of the PCB.

8. An antenna system comprises:

a printed circuit board (PCB);

four diodes;

four antenna units, equally spaced from a center and disposed on four sides of the center, each of the antenna units including two antennas including one radiator and one reflector, wherein two reflectors in each of the antenna units are coupled via one of the four diodes, the antennas in each of the antenna units are structured with copper straps on the PCB, wherein each of the diodes is electrically controlled to be one or off to connect or disconnect the two reflectors so as to change a radiation pattern of the antenna system, and wherein the antenna units are equally driven by a power source disposed at the center.

9. The antenna system as recited in claim 8, further comprising a switch control unit to control the diodes.

10. The antenna system as recited in claim 9, wherein the switch control unit is designed to receive a feedback signal and to control the diodes according to the feedback signal.

11. The antenna system as recited in claim 8, wherein the antenna units are powered by the power source via respective copper straps on the PCB.

12. The antenna system as recited in claim 8, wherein each of the diodes is soldered across two of the reflectors.

13. The antenna system as recited in claim 8, wherein the two antennas are disposed on both sides of the PCB.

14. The antenna system as recited in claim 13, wherein each of the two reflectors bent on one end and extended to a corner formed by two neighboring antenna units to isolate respective radiations from the two neighboring antenna units.

* * * * *